US006838427B2

(12) United States Patent
Ushio et al.

(10) Patent No.: US 6,838,427 B2
(45) Date of Patent: Jan. 4, 2005

(54) SOFTENER COMPOSITION

(75) Inventors: Noriaki Ushio, Wakayama (JP); Atsushi Yamamoto, Wakayama (JP); Shuji Tagata, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/162,877

(22) Filed: Jun. 6, 2002

(65) Prior Publication Data

US 2003/0060389 A1 Mar. 27, 2003

(30) Foreign Application Priority Data

Jun. 8, 2001 (JP) ..... 2001-174057
Sep. 7, 2001 (JP) ..... 2001-271594

(51) Int. Cl.[7] ..... C11D 1/86
(52) U.S. Cl. ..... 510/515
(58) Field of Search ..... 510/515

(56) References Cited

U.S. PATENT DOCUMENTS

| | | | | | |
|---|---|---|---|---|---|
| 3,325,404 | A | | 6/1967 | Cohen et al. | |
| 4,000,077 | A | | 12/1976 | Wixon | |
| 4,308,024 | A | | 12/1981 | Wells | |
| 4,486,195 | A | * | 12/1984 | Weinstein et al. | 8/137 |
| 4,948,520 | A | | 8/1990 | Sasaki | |
| 5,108,628 | A | * | 4/1992 | Uphues et al. | 252/8.63 |
| 5,133,885 | A | * | 7/1992 | Contor et al. | 510/521 |
| 6,420,331 | B1 | * | 7/2002 | Bettiol et al. | 510/392 |
| 6,541,438 | B1 | * | 4/2003 | Smets et al. | 510/392 |

FOREIGN PATENT DOCUMENTS

| | | | |
|---|---|---|---|
| EP | 0026528 | A1 | 4/1981 |
| EP | 0643128 | A1 | 3/1995 |
| JP | 61-37387 | | 8/1986 |
| JP | 5-132865 | | 5/1993 |
| JP | 7-268773 | | 10/1995 |
| JP | 9-111660 | | 4/1997 |
| WO | WO 99/57252 | * | 11/1999 |

* cited by examiner

*Primary Examiner*—John R. Hardee
(74) *Attorney, Agent, or Firm*—Birch, Stewart, Kolasch & Birch, LLP

(57) ABSTRACT

A softener composition improves the feeling of clothes and can impart high softening effect to clothes irrespective of the state of rinsing water and comprises (a) a compound represented by the formula (1) or (2), (b) a compound represented by the formula (3) or (4) and (c) a specific anionic surfactant, wherein the mole ratio between the component (a), the component (b) and the component (c) satisfies the following relationship: [(a)+(b)]/(c)=9/1 to 4/6:

(1)

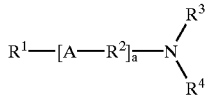

(2)

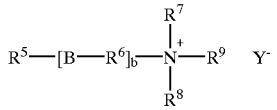

(3)

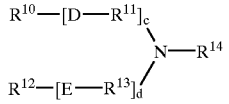

(4)

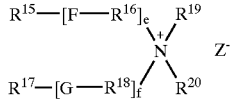

wherein $R^1$ and $R^5$ respectively represent a $C_{13-36}$ alkyl group or the like, $R^{10}$, $R^{12}$, $R^{15}$ and $R^{17}$ respectively represent a $C_{8-36}$ alkyl group or the like, $R^2$, $R^6$, $R^{11}$, $R^{13}$, $R^{16}$ and $R^{18}$ respectively represent a $C_{1-6}$ alkylene group, $R^3$, $R^4$, $R^7$, $R^8$, $R^9$, $R^{14}$, $R^{19}$ and $R^{20}$ respectively represent a $C_{1-3}$ alkyl group or the like, A, B, D, E, F and G respectively represent —COO—, —CONH— or the like, a to f respectively denote 0 or 1 and $Y^-$ and $Z^-$ respectively represent an anionic group.

3 Claims, No Drawings

SOFTENER COMPOSITION

TECHNICAL FIELD OF THE INVENTION

The present invention relates to a softener composition.

PRIOR ARTS

Conventionally, a quaternary ammonium salt having a long-chain alkyl group or an acid salt of a tertiary amine is used for softeners. These softeners have a good softening effect on various fabrics in a small amount. It is however known that these softeners make fabrics have an oily finish. Therefore, softeners improving the feeling of clothes are being desired.

In order to eliminate these drawbacks, a method is disclosed in which a combination of a dialkyl quaternary ammonium compound and an anionic surfactant is used in JP-B No. 61-37387 and a softener composition prepared by combining a softening component having two or more cationic group in its molecule with an anionic surfactant is disclosed in JP-A No. 9-111660. However, these technologies cannot make compatible flexibility and the feeling of finished clothes.

Also, softeners are added in a rinsing stage after clothes to be cleaned are washed using a general weak alkali detergent. The pH of the rinsing water and the amount of a residual activator are changed according to the amount of washing, the amount of wash water and the amount of the detergent. Therefore, as the softener, those are desired which has a softening effect unaffected even if there is a change in the condition of the rinsing water.

In the meantime, it has been already known that a mono long-chain alkyl type softening base is used for softeners. A softener composition using a mono long-chain alkyl tertiary amine having an ester group or an amide group and a specific ester compound is disclosed in the publication of JP-A No. 7-268773. Also, a softener composition in which an amine compound and an anionic surfactant are carried on a base in the condition that the both are not mingled with each other is disclosed in the publication of JP-A No. 5-132865. However, these disclosed softeners cannot also improve oily feeling. Also, there is a problem that the softening effect is reduced when the pH of the rinsing water is weakly alkaline and the residual activator exists in a large amount.

U.S. Pat. No. 4,000,077 discloses combination of a cationic softener with a higher alcohol sulfate at a mixing ratio of 10/1–2/1.

DISCLOSURE OF INVENTION

It is an object of the present invention to provide a softener composition which improves the feeling of clothes and can impart a high softening effect to clothes irrespective of the condition of rinsing water.

The present invention provides a softener composition comprising the following component (a), component (b) and component (c), wherein the mole ratio between the component (a), the component (b) and the component (c) satisfies the following relationship: [(a)+(b)]/(c)=9/1 to 4/6.

(a) at least one selected from the group consisting of a tertiary amine represented by the formula (1), a salt thereof (hereinafter referred to as a compound (1)) and a quaternary ammonium salts (hereinafter referred to as a compound (2)) represented by the formula (2):

(1)

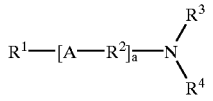

(2)

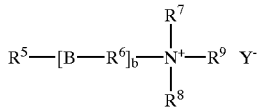

wherein $R^1$ and $R^5$ respectively represent an alkyl group or an alkenyl group having 13 to 36 carbon atoms, $R^2$ and $R^2$ respectively represent an alkylene group having 1 to 6 carbon atoms, $R^3$, $R^4$, $R^7$, $R^8$ and $R^9$ respectively represent an alkyl hydroxyalkyl group having 1 to 3 carbon atoms, A and B respectively represent a group selected from —COO—, —OCO—, —CONH— or —NHCO—, a and b respectively denote a number of 0 or 1 and $Y^-$ represents an anionic (b) at least one selected from the group consisting of a tertiary amine represented by the formula (3), a salt thereof (hereinafter referred to as a compound (3)) and a quaternary ammonium salt (hereinafter referred to as a compound (4)) represented by the formula (4):

(3)

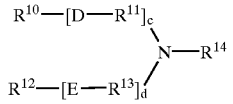

(4)

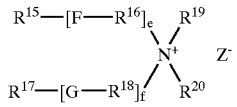

wherein $R^{10}$, $R^{12}$, $R^{15}$ and $R^{17}$ respectively represent an alkyl group or an alkenyl group having 8 to 36 carbon atoms, $R^{11}$, $R^{13}$, $R^{16}$ and $R^{18}$ respectively represent an alkylene group having 1 to 6 carbon atoms, $R^{14}$ represents an alkyl or hydroxyalkyl group having 1 to 3 carbon atoms or a group represented by the formula $R^{10}$-[D-$R^{11}$]$_c$—, $R^{19}$ represents an alkyl or hydroxyalkyl group having 1 to 3 carbon atoms or a group represented by the formula $R^{15}$—[F—$R^{16}$]$_e$—, $R^{20}$ represents an alkyl group or a hydroxyalkyl group having 1 to 3 carbon atoms, D, E, F and G respectively represent a group selected from —COO—, —OCO—, —CONH— and —NHCO—, c, d, e and f respectively represent a number of 0 or 1 and $Z^-$ represents an anionic group.

(c) an anionic surfactant having a hydrocarbon group having 8 to 36 carbon atoms and a —$SO_3M$ group and/or a $OSO_3M$ group (M: counter ion) in its molecule.

DETAILED EXPLANATION OF INVENTION

[Component (a)]

The component (a) of the present invention is one or more types selected from the compound (1) and the compound (2). In the compound (1), $R^1$ is an alkyl group or an alkenyl group having 13 to 36 and preferably 14 to 24 carbon atoms. $R^2$ is preferably an alkylene group having 1 to 4 carbon atoms. $R^3$ and $R^4$ are respectively preferably a methyl group, an ethyl group or a hydroxyethyl group, a is preferably 1.

Particularly preferable examples among the compounds (1) include at least one selected from compounds represented by the formula (1-1) and compounds represented by the formula (1-2).

(1-1)

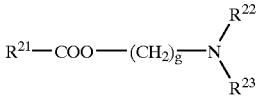

(1-2)

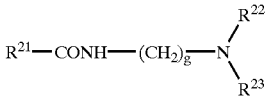

wherein $R^{21}$ is an alkyl group or an alkenyl group having 13 to 35 carbon atoms, preferably 15 to 23, the most preferably 17 to 19, g is 2 or 3, $R^{22}$ and $R^{23}$ are respectively a methyl group, an ethyl group or a hydroxyethyl group and preferably a methyl group or a hydroxyethyl group.

The compounds represented by the formula (1-1) or (1-2) may be easily synthesized, for example, by reacting a fatty acid represented by the formula $R^{21}$—COOH or its alkyl (1 to 5 carbon atoms) ester or an acid chloride with a N-hydroxyalkyl-N,N-dialkylamine or a N-aminoalkyl-N,N-dialkylamine, wherein $R^{21}$ may be a single alkyl chain length or a mixed alkyl chain length.

The compound (1) may be a salt neutralized by an inorganic or organic acid. Also, when the compound (1) is used as a salt, one whose amino group is neutralized using an acidifier before it is compounded in the softener composition may be used or the amino group may be neutralized after the component (a) is compounded in the softener composition. As the acid for neutralization, hydrochloric acid, sulfuric acid, phosphoric acid, glycolic acid, hydroxycarboxylic acid, citric acid, a sulfonic or carboxylic acid having an aromatic hydrocarbon group in its molecule, a fatty acid having 1 to 12 carbon atoms or an alkylsulfuric acid having 1 to 3 carbon atoms is preferable. Hydrochloric acid, sulfuric acid, glycolic acid, citric acid or p-toluenesulfonic acid is particularly preferable. The acidifier for neutralization may be used either singly or in plural.

In the compound (2), $R^5$ is an alkyl group or an alkenyl group having 13 to 36 and preferably 14 to 24 carbon atoms. $R^6$ is preferably an alkylene group having 1 to 4 carbon atoms. $R^7$, $R^8$ and $R^9$ are respectively preferably a methyl group, an ethyl group or a hydroxyethyl group. Examples of particularly preferable compounds among the compounds (2) include one or more types selected from compounds represented by the formula (2-1) and compounds represented by the formula (2-2).

(2-1)

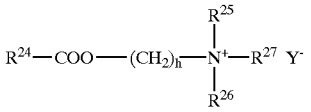

(2-2)

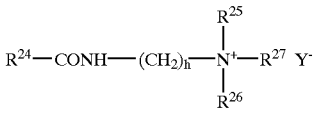

wherein $R^{24}$ is an alkyl group or an alkenyl group having 13 to 35 carbon atoms, preferably 15 to 23, the most preferably 15 to 17, h is 2 or 3, $R^{25}$, $R^{26}$ and $R^{27}$ are respectively a methyl group, an ethyl group or a hydroxyethyl group and preferably a methyl group or a hydroxyethyl group. $Y^-$ is an anionic group and preferably one or more types selected from a halogen ion, a sulfuric acid ion, a phosphoric acid ion, an alkyl sulfate ion having 1 to 3 carbon atoms, a fatty acid ion having 1 to 12 carbon atoms and an arylsulfonic acid ion which may be substituted with an alkyl group having 1 to 3 carbon atoms.

The compound represented by the formula (2-1) or (2-2) may be easily synthesized by reacting a fatty acid represented by the formula $R^{24}$—COOH, its alkyl (1 to 5 carbon atoms) ester or acid chloride with a N-hydroxyalkyl-N,N-dialkylamine or a N-aminoalkyl-N,N-dialkylamine and by further converting the resulting reaction product into a quaternary compound using an alkylating agent such as an alkyl halide, dialkylsulfuric acid or alkylene oxide. Also, the compound represented by the formula (2-1) or (2-2) may be synthesized by a reaction between a N,N,N-trialkyl-N-hydroxyalkyl quaternary ammonium salt or a N,N,N-trialkyl-N-aminoalkyl quaternary ammonium salt and a fatty acid represented by the formula $R^{24}$—COOH or its alkyl (1 to 5 carbon atoms) ester or acid chloride. $R^{24}$ may be a single alkyl chain length or a mixed alkyl chain length.

The component (a) of the present invention is preferably the compound (1) or a combination of the compound (1) with the compound (2) in view of softening effect. When the combination of the compounds (1) with (2) is used, the mass ratio of the compound (1)/the compound (2) is preferably 1/1000 to 1000/1, particularly 1/100 to 10/1.

[Component (b)]

The component (b) of the present invention is one or more types selected from the compound (3) and the compound (4). In the compound (3), $R^{10}$ and $R^{12}$ are respectively an alkyl or alkenyl group having 8 to 36 carbon atoms, preferably 8 to 24, more preferably 9 to 20 carbon atoms, particularly preferably an alkyl group having 9 to 14 carbon atoms or an alkenyl group having 16 to 20 carbon atoms. $R^{11}$ and $R^{13}$ are respectively an alkylene group having preferably 1 to 4 carbon atoms and particularly preferably an alkylene group having 2 or 3 carbon atoms. c and d are respectively preferably 1. D and E are respectively preferably —COO— and/or —CONH—. $R^{14}$ is preferably a methyl group, ethyl group or hydroxyethyl group.

The compound (3) may be a salt neutralized by an inorganic or organic acid. Also, when the compound (3) is used as a salt, one whose amino group is neutralized using an acidifier before it is compounded in the softener composition may be used or the amino group may be neutralized after the component (b) is compounded in the softener composition. As the acid for neutralization, hydrochloric acid, sulfuric acid, phosphoric acid, glycolic acid, hydroxycarboxylic acid, citric acid, a sulfonic or carboxylic acid having an aromatic hydrocarbon group in its molecule, fatty acid having 1 to 12 carbon atoms or alkylsulfuric acid having 1 to 3 carbon atoms is preferable and hydrochloric acid, sulfuric acid, glycolic acid, citric acid or p-toluene sulfonic acid is particularly preferable. These acidifiers to be used for neutralization may be used either singly or in plural.

Also, in the compound (4), $R^{15}$ and $R^{17}$ are respectively an alkyl group or an alkenyl group having 8 to 36 and preferably 8 to 24 carbon atoms and particularly preferably an alkyl group having 8 to 16 carbon atoms or an alkenyl group having 16 to 20 carbon atoms. $R^{16}$ and $R^{18}$ respectively preferably an alkylene group having 1 to 4 carbon atoms and particularly preferably an alkylene group having 2 to 3 carbon atoms. e and f are respectively 1 and F and G are respectively preferably —COO— and/or —CONH—. $R^{19}$ and $R^{20}$ are respectively preferably a methyl group, ethyl group or hydroxyethyl group. $Z^-$ is an anionic group and preferably one or more types selected from a halogen ion, sulfuric acid ion, phosphoric acid ion, alkyl sulfate ion having 1 to 3 carbon atoms, fatty acid ion having 1 to 12 carbon atoms and arylsulfonic acid ion which may be substituted with an alkyl group having 1 to 3 carbon atoms.

As examples of preferable compounds among the compounds (3), compounds represented by the formulae (3-1) to (3-3) may be given and as examples of preferable compounds among the compounds (4), compounds represented by the formulae (4-1) to (4-4) may be given.

(3-1)

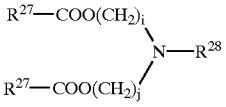

(3-2)

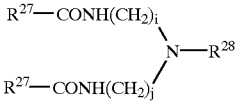

(3-3)

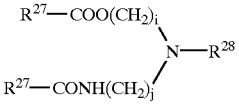

(4-1)

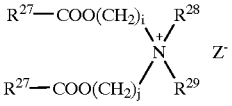

(4-2)

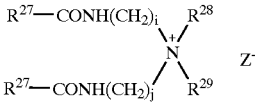

(4-3)

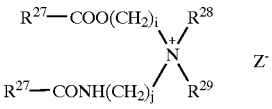

(4-4)

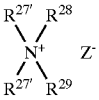

wherein, $R^{27}$ is an alkyl or alkenyl group having 9 to 23 carbon atoms, preferably an alkyl group having 9 to 17 carbon atoms or oleyl group, more preferably an alkyl group having 11 to 15 carbon atoms or an alkenyl group having 15 to 17 carbon atoms, i and j are respectively a number of 2 or 3, $R^{28}$ is a methyl group, an ethyl group, a hydroxyethyl group or a group represented by the formula $R^{27}$—COO$(CH_2)_i$—, $R^{29}$ is a methyl group, an ethyl group or a hydroxyethyl group and $Z^-$ has the same meaning as above; wherein $R^{27'}$ is an alkyl or alkenyl group having 8 to 20 carbon atoms, preferably an alkyl group having 10 to 14 carbon atoms or an alkyl group having 16 to 18 carbon atoms.

The component (b) of the present invention is preferably the compound (4) or a combination of the compound (3) with the compound (4) in view of softening effect. When the combination of the compounds (3) and (4) is used, the mass ratio of the compound (3)/the compound (4) is preferably 1/1000 to 1000/1.

[Component (c)]

The component (c) of the present invention is an anionic surfactant containing a hydrocarbon group such as an alkyl or alkenyl group having 8 to 36 carbon atoms, preferably 14 to 36, more preferably 16 to 24, especially preferably 18 to 24, and a —$SO_3M$ group and/or a —$OSO_3M$ group [M: counter ion] in its molecule. Specifically, an alkylbenzenesulfonic acid, alkyl (or alkenyl) sulfate, polyoxyalkylene alkyl (or alkenyl) ether sulfate, olefinsulfonic acid, alkanesulfonic acid, α-sulfo-fatty acid, α-sulfo-fatty acid ester and salts of these compounds in which the alkyl group or the alkenyl group has the above carbon number are preferable. Among these compounds, particularly at least one selected from an alkyl (or alkenyl) sulfate having an alkyl group or an alkenyl group having 14 to 26 carbon atoms, a polyoxyethylene alkyl (or alkenyl) ether sulfate which has an alkyl group or an alkenyl group having 14 to 26 carbon atoms and in which the number of average addition mols of an ethylene oxide (hereinafter expressed as EO) is 1 to 6, preferably 1 to 4 and particularly preferably 1 to 3 and its salt are preferable. The most preferable is an alkyl (or alkenyl) sulfate having an alkyl or alkenyl group having 18 to 24 carbon atoms or a salt thereof. As the salt, a sodium salt, potassium salt, ammonium salt or alkanolamine salt is preferable from the viewpoint of storage stability.

[Softener Composition]

The softener composition of the present invention preferably contains the component (a) in an amount of preferably 3 to 40 mass %, more preferably 5 to 40 mass % and particularly preferably 5 to 35 mass %, the component (b) in an amount of preferably 1 to 20 mass %, more preferably 1 to 15 mass % and particularly preferably 2 to 15 mass % from the viewpoint of softening effect and feeling. Also, the softener composition preferably contains the component (c) in an amount of 0.5 to 30 mass %, more preferably 1 to 25 mass %, particularly preferably 1 to 20 mass % and most preferably 1 to 10 mass % from the viewpoint of softening effect and feeling.

In the softening composition of the present invention, it is preferable that each mole ratio of the component (a), the component (b) and the component (c) satisfy the following relationship: [(a)+(b)]/(c)=preferably 9/1 to 4/6, more preferably 9/1 to 5.5/4.5, particularly preferably 8.5/1.5 to 6.5/3.5, the most preferably 8.5/1.5 to 7/3 from the viewpoint of softening effect and feeling. The mass ratio (a)/(b) of the component (a) to the component (b) is preferably 1/10 to 100/1, preferably 1/3 to 50/1, more preferably 1/2 to 50/1, particularly preferably 1/2 to 25/1, the most preferably 2/3 to 10/1 from the viewpoint of an effect on rinsing water. Also, it is preferable that the component (a), the component (b) and the component (c) be contained in a total amount of 5 to 60 mass % and particularly 10 to 50 mass % from the viewpoint of softening effect, feeling and storage stability.

The softening composition of the present invention has the form of an aqueous solution prepared by diluting the component (a), the component (b) and the component (c) in water. The water to be used is preferably distilled water, ion-exchanged water or ion-exchanged water including 0.5 to 5 mg/kg of a hypochlorous acid salt. Water is compounded in the composition in an amount of 30 to 95 mass % and preferably 50 to 85 mass % in view of storage stability.

Moreover, the composition of the present invention is preferably adjusted to pH 1 to 8.5, more preferably 1 to 8, particularly preferably 2 to 8 and most preferably 2 to 6.5 at 20° C. from the viewpoint of storage stability.

It is preferable in the present invention that in addition to the aforementioned component (a), component (b) and component (c), an organic solvent having a log P of 0.2 to 3, preferably 0.5 to 3, more preferably 0.8 to 2, particularly preferably 1 to 1.9, the most preferably 1.1 to 1.6 be used as a component (d) from the viewpoint of the desirable appearance and storage stability of the composition. Here, the desirable appearance means a uniformly dispersed state or transparent state of the softener composition and particularly an aesthetically desirable transparent state in the present invention. Also, the log P is a factor indicating the affinity of an organic compound to water and 1-octanol. A 1-octanol/water distribution coefficient P is a distribution coefficient obtained when a trace amount of a compound is dissolved as a solute in a solvent of a two-liquid phase consisting of 1-octanol and water, means the ratio of the equilibrium concentrations of the compound in each solvent and is usually expressed by the form of log P which is a logarithm of the ratio to the base 10. The log P can be found because the values of log P of many compounds have been reported and many values are listed in the databases available from Daylight Chemical Information Systems, Inc. (Daylight CIS) and the like. In the case where there is no actual log P value, it is most convenient to calculate based on the program "CLOGP" available from Daylight CIS. When there is an actual value of log P, this program outputs the value of "calculated log P (Clog P) calculated through the fragment approach of Hansch Leo together with the actual value. The fragment approach is based on the chemical structure of a compound, taking the number of atoms and the type of chemical bond into account (cf. A. Leo Comprehensive Medicinal Chemistry, Vol. 4 C. Hansch, P. G. Sammens, J. B. Taylor and C. A. Ramsden, Eds., P. 295, Pergamon Press, 1990). Because this value of log P is most common and reliable estimated value, it may be used in place of actual value of log P in the selection of a compound. In the present invention, in the case where there is an actual value of log p, it is used whereas in the case where there is no actual value of log P, the value of Clog P calculated based on the program CLOGP v4.01 is used.

The organic solvent having such a log P is preferably compounds represented by the following formula (5), formula (6) and formula (7).

$$R^{30}—OH \quad (5)$$

wherein $R^{30}$ is a hydrocarbon group having 3 to 8 carbon atoms, preferably a hydrocarbon group having 4 to 8 carbon atoms, more preferably an alkyl, aryl or arylalkyl group having 4 to 8 carbon atoms.

$$R^{31}—(O—R^{32})_k—O—R^{33} \quad (6)$$

wherein $R^{31}$ and $R^{33}$ are respectively a hydrogen atom, a group represented $R^{34}CO—$($R^{34}$ is an alkyl group having 1 to 3 carbon atoms) or a hydrocarbon group having 1 to 7 carbon atoms, preferably a hydrogen atom or an alkyl, aryl or arylalkyl group having 1 to 7 carbon atoms, $R^{32}$ is an alkylene group which has 2 to 9 carbon atoms and may have a branched chain and k is a number of 1 to 5.

$$R^{35}—O—CH_2CH(O—R^{36})CH_2—O—R^{37} \quad (7)$$

wherein $R^{35}$ is an alkyl group having 3 to 8 carbon atoms and $R^{36}$ and $R^{37}$ are respectively a hydrogen atom or an alkyl group which has 1 to 3 carbon atoms and which may be substituted with a hydroxy group.

Specific examples of preferable compounds used as the organic solvent may include n-butanol, isobutanol, n-propanol, ethylene glycol mono-n-hexyl ether, diethylene glycol mono-n-hexyl ether, ethylene glycol mono-2-ethylhexyl ether and diethylene glycol mono-2-ethylhexyl ether, 2-butanol, n-hexanol, cyclohexanol, phenol, benzyl alcohol, phenethyl alcohol, 2-phenoxyethanol, 2-benzyloxyethanol, diethylene glycol monobenzyl ether, diethylene glycol monophenyl ether, triethylene glycol monophenyl ether, tetraethylene glycol monophenyl ether, 2-ethylhexane-1,3-diol, hexane-1,6-diol, nonane-1,6-diol, 2-methyloctane-1,8-diol, 2-butoxyethanol, diethylene glycol monobutyl ether, triethylene glycol monobutyl ether, 2-(2-methyl)propoxyethanol, diethylene glycol mono-2-methylpropyl ether, 2-propoxy-1-propanol, dipropylene glycol monopropyl ether, 2-butoxy-1-propanol, dipropylene glycol monobutyl ether, 2-t-butoxy-1-propanol, 2-phenoxy-1-propanol, 2-ethoxypropyl-1-acetate, 2-propoxypropyl-1-acetate, 1,2-diacetoxypropane, 3-dimethyl-3-methoxy-1-propanol, 1,3-dimethylbutyl glyceryl ether or pentyl glyceryl ether, hexyl glyceryl ether or propylene glycol mono-butylether.

Among these compounds, particularly hexylglyceryl ether, di-propyleneglycol mono-butylether, propyleneglycol mono-butylether, propyleneglycol mono-phenylether, di-ethyleneglycol mono-butylether, n-propanol, ethylene glycol mono-n-hexyl ether, diethylene glycol mono-n-hexyl ether, ethylene glycol mono-2-ethylhexyl ether and diethylene glycol mono-2-ethylhexyl ether, n-hexanol, benzyl alcohol, 2-phenoxyethanol, 2-benzyloxyethanol, diethylene glycol monophenyl ether, triethylene glycol monophenyl ether, tetraethylene glycolmonophenyl ether, hexane-1,6-diol, nonane-1,6-diol, 2-propoxy-1-propanol, dipropylene glycol monopropyl ether and pentyl glyceryl ether are preferable.

Hexylglyceryl ether, di-propyleneglycol mono-butylether, propyleneglycol mono-butylether, propyleneglycol mono-phenylether, benzyl alcohol, 2-phenoxyethanol, 2-benzyloxyethanol, diethylene glycol monophenyl ether, triethylene glycol monophenyl ether, tetraethylene glycol monophenyl ether and nonane-1,9-diol are the most preferable.

The composition of the present invention contains the component (d) in an amount of preferably 0.5 to 40 mass %, more preferably 1 to 35 mass % and particularly preferably 5 to 30 mass %. When the component (d) is used and the compounds (3-1) to (3-3) and (4-1) to (4-3) are used as a component (b) in the present invention, the hydrocarbon group $R^{27}$ is preferably an alkyl group having 9 to 13 carbon atoms to obtain a desirable appearance. Also, when the compound (4-4) is used as the component (b), the hydrocarbon group $R^{27'}$ is preferably an alkyl group having 10 to 14 carbon atoms to obtain a desirable appearance.

It is preferable in the present invention that in addition to the aforementioned component (a), component (b) and component (c), a saturated or unsaturated fatty acid having 12 to 36, preferably 14 to 24 and more preferably 14 to 20 carbon atoms or its salt be contained as a component (e) with the view of improving softening effect and feeling effect. Specifically, as the component (e), lauric acid, myristic acid, palmitic acid, stearic acid, oleic acid or mixtures of these acids are preferable and particularly one or more types selected from palmitic acid, stearic acid and oleic acid are preferable. Also, a fatty acid having the alkyl composition of fatty acid derived from palm oil or beef tallow is preferable. When using the salt, a sodium salt, potassium salt, magnesium salt and alkanolamine salt are preferable and a sodium salt and potassium salt are preferable from the viewpoint of storage stability. The amount of the component (e) to be compounded is preferably 0.01 to 5 mass % and particularly preferably 0.05 to 3 mass % in the composition. Also, the mass ratio of the component (e)/[the component (a)+the component (b)] is preferably 1/500 to 1/10 and particularly 1/300 to 1/50 from the viewpoint of softening effect.

It is preferable in the present invention that in addition to the aforementioned component (a), component (b) and component (c), a nonionic surfactant be further compounded as a component (f) from the viewpoint of storage stability. As the nonionic surfactant, one or more types selected from a polyoxyethylene alkyl ether, polyoxyethylenealkylamine, polyoxyethylenealkylamide, an alkylene oxide adduct to fats and oils or partial hydrolysates of fats and oils and a condensed reaction product of fats and oils, glycerol and an alkylene oxide, having an alkyl or alkenyl group having 8 to 20 carbon atoms, are preferable. Particularly a nonionic surfactant represented by the formula (8) is preferable.

$$R^3—U—[(R^{39}O)_m—H]_n \quad (8)$$

wherein $R^{38}$ is an alkyl group or an alkenyl group having 10 to 18 and preferably 12 to 18 carbon atoms, $R^{39}$ is an alkylene group having 2 to 3 carbon atoms and preferably an ethylene group, m is a number of 2 to 100, preferably 5 to 80 and particularly preferably 10 to 60 and U is —O—, —CON< or —N< provided that when U is —O—, n is 1 and when U is —CON< or —N<—, n is 2.

Specific examples of the compound represented by the formula (8) may include the following compounds.

$$R^{38}—O—(C_2H_4O)_p—H$$

wherein $R^{38}$ has the same meaning as above and p is a number of 8 to 100 and preferably 10 to 60.

$$R^{38}—O—(C_2H_4O)_q—(C_3H_6O)_r—H$$

wherein $R^{38}$ has the same meaning as above, q and r are respectively a number of 2 to 40 and preferably 5 to 40, wherein EO and propylene oxide (hereinafter expressed as PO) may be either a random or block adduct.

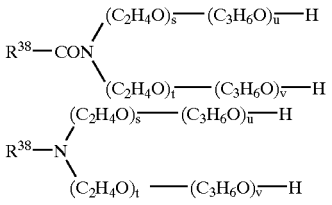

wherein $R^{38}$ has the same meaning as above, s, t, u and v are respectively a number of 0 to 40 and preferably 5 to 40 provided that s+t+u+v is a number of 5 to 60 and preferably 5 to 40, wherein EO and PO may be either a random or block adduct.

The amount of the nonionic surfactant to be added as the component (f) is preferably 0.5 to 10 mass % and particularly preferably 1 to 8 mass % in the composition in view of stability.

Also, the softener composition of the present invention may contain an inorganic salt as a component (g). As the inorganic salt, sodium chloride, calcium chloride, sodium sulfate, magnesium sulfate, magnesium chloride and carboxylates or sulfonates having an aromatic group in its molecule are preferable. Sodium chloride, sodium sulfate, magnesium chloride and p-toluene sulfonate are preferable in view of storage stability. The inorganic salt is desirably added in an amount of 0 to 2 mass %, preferably 5 mg/kg to 1 mass %, more preferably 10 to 8000 mg/kg, much more preferably 10 to 5000 mg/kg, the most preferably 10 to 4500 mg/kg in the composition. It is to be noted that although sodium salts and potassium salts are included in surfactants such as fatty acid salts, inorganic salts mingled in the composition by using such surfactants are free from the above limitation.

Also, the softener composition of the present invention may use, as a component (h), a solvent other than the component (d). Specifically, the component (h) is preferably a solvent selected from ethanol, isopropanol, glycerol, ethylene glycol and propylene glycol. These components (h) may be compounded in the composition in an amount of 0 to 20 mass % and particularly 0.5 to 10 mass %. In the case of using ethanol, it is preferable to use polyoxyethylene alkyl ether sulfate-modified ethanol or 8-acetylated cane sugar-modified ethanol.

In the present invention, an ester compound of a saturated or unsaturated fatty acid having 8 to 22 carbon atoms and a polyhydric alcohol may be compounded as a component (i) with the view of improving storage stability. Specifically preferable examples of the compound may include triglyceride, diglyceride, monoglyderide and mono-, di- or tri-ester of pentaerythritol, sorbitan ester. The amount of these compounds to be compounded is preferably 5 mass % or less, more preferably 3 mass % or less and particularly preferably 1 mass % or less.

Commonly known sequestering agents and antioxidants may be compounded in the softener composition of the present invention to improve the color and smell obtained after the composition is stored. Examples of the sequestering agents may include aminocarboxylic acids represented by ethylenediamine tetraacetate, diethylenetriamine pentaacetate and the like, inorganic phosphorous compounds represented by tripolyphosphate and pyrophosphate and organic phosphoric acids represented by 1-hydroxyethane-1,1-diphosphonate, polyphosphonate and phytic acid. Examples of the antioxidant may include 2,6-di-tert-butyl-4-methylphenol and 2(3)-butyl-4-oxyanisole. These antioxidants may be compounded as acids or salts. These sequestering agents and antioxidants are compounded in the softener composition in an amount ranging from 0.1 to 1000 ppm on the basis of the component (a).

In the softener composition of the present invention, components, which are commonly compounded in a fiber processing agent, such as silicone, perfumes (particularly preferably a combination of perfumery components represented by the components (c) and (d) described in the publication of JP-A No. 8-113871) and dye may be compounded.

As the method for producing the softener composition of the present invention, a method in which the component (f) and the component (h) are dissolved in water according to the need, the temperature of the solution is raised under heating to 40 to 70° C. and preferably 45 to 65° C., thereafter the component (a), the component (b), the component (c) and, as required, the component (d), the component (e), the component (g) and the component (i) are added to the solution, which is then mixed with stirring, the reaction solution is adjusted to a given pH and cooled and then other components are added is preferable in view of storage stability.

The softener composition of the present invention produces an excellent softening effect also when the pH of rinsing water is weakly alkaline and a large amount of a residual activator is present and can also improve an oily feeling.

EXAMPLE

Synthetic Example 1

Synthesis of (a-1)

(a-1) was synthesized by a dehydration esterification reaction between a mixed fatty acid obtained by mixing palmitic acid/stearic acid in a ratio of 50/50 (mass ratio) and N-hydroxyethyl-N,N-dimethylamine. Specifically, 132 g of N-hydroxyethyl-N,N-dimethylamine, 200 g of palmitic acid and 200 g of stearic acid were placed in a four-neck flask equipped with a stirrer, a temperature gage and a dehydrating pipe and the mixture was raised to 150° C. The mixture was stirred under heating at this temperature for 4 hours while distilling generated water. Moreover, the mixture was raised to 180° C., and heating and stirring were continued for 10 hours while 66 g of N-hydroxyethyl-N,N-dimethylamine was added dropwise to the mixture. Thereafter, the reaction mixture was cooled to 120° C. and unreacted amine was distilled under reduced pressure to obtain 473 g of the target N-alkanoyloxyethyl-N,N-dimethylamine (a-1).

Synthetic Example 2

Synthesis of (a-2)

(a-2) was synthesized by a dehydration amidation reaction between stearic acid and N,N-dimethyl-1,3-propanediamine. Specifically, 161 g of N,N-dimethyl-1,3-propanediamine and 373.3 g of the fatty acid were placed in a four-neck flask equipped with a stirrer, a temperature gage and a dehydrating pipe and the mixture was raised to 180° C. The mixture was stirred under heating at this temperature for about 5 hours while distilling generated water. Then, the reaction mixture was cooled to 120° C. and unreacted amine was distilled under reduced pressure to obtain the target N-stearoylaminopropyl-N,N-dimethylamine (a-2).

Synthetic Example 3

Synthesis of (a-3)

N-oleoylaminopropyl-N,N-dimethylamine (a-3) was synthesized in the same method as in Synthetic Example 2 except that oleic acid was used in place of stearic acid.

Synthetic Example 4

Synthesis of (a-4)

(a-4) was synthesized using the component (a-1) produced in Synthetic Example 1 and methyl chloride. Specifically, an autoclave was charged with 100 g of the component (a-1) and 300 g of ethanol and the atmosphere in the autoclave was replaced by nitrogen. Then, the mixture was raised up to 100° C. with stirring. Thereafter, 18 g of methyl chloride was introduced under pressure into the autoclave by using a pressure pump and the mixture was reacted for 3 hours. After the reaction mixture was cooled, ethanol was distilled under reduced pressure to obtain the target N-alkanoyloxyethyl-N,N,N-trimethylammonium chloride (a-4).

Synthetic Example 5

Synthesis of (a-5)

The target N-stearoylaminopropyl-N,N,N-trimethylammonium chloride (a-5) was obtained using the component (a-2) produced in Synthetic Example 2 and methyl chloride in the same method as in Synthetic Example 4.

Synthetic Example 6

Synthesis of (a-6)

The target N-oleoylaminopropyl-N,N,N-trimethylammonium chloride (a-6) was obtained using the component (a-3) produced in Synthetic Example 3 and methyl chloride in the same method as in Synthetic Example 4.

Synthetic Example 7

Synthesis of (ab-1)

(ab-1) was synthesized by a dehydration esterification reaction and by a dehydration amidation reaction between oleic acid and N-methyl-N-hydroxyethyl-1,3-propanediamine. Specifically, a 1000 ml four-neck round-bottom flask equipped with a stirrer, a temperature gage, a nitrogen introduction pipe and a dehydration pipe was charged with 119.2 g (1.00 mol) of N-methyl-N-hydroxyethyl-1,3-propanediamine and 434.5 g (1.53 mol) of oleic acid. The pressure in the flask was reduced to 26.7 kPa and the mixture was raised to 180° C. The mixture was reacted for 7 hours as it was and then cooled to obtain a mixture of N-oleoylaminopropyl-N-hydroxyethyl-N-methylamine and N-oleoylaminopropyl-N-oleoyloxyethyl-N-methylamine. 300.0 g of the mixture and 58.5 g of ethanol were placed in an autoclave equipped with a stirrer, a temperature gage and an introduction pipe and 38.8 g (0.768 mol) of methyl chloride was introduced under pressure into the autoclave. After that, the mixture was raised to 80° C. and reacted for 4 hours. After the reaction mixture was cooled to 60° C., the residual pressure was blown down to obtain an intended mixture of N-oleoylaminopropyl-N-hydroxyethyl-N,N-dimethylammonium chloride and N-oleoylaminopropyl-N-oleoyloxyethyl-N,N-dimethylammonium chloride (weight ratio: 65/35) (ab-1).

Synthetic Example 8

Synthesis of (ab-2)

(ab-2) was synthesized by a dehydration esterification reaction between oleic acid and N,N-dihydroxyethyl-N-methylamine. Specifically, a 1000 ml four-neck round-bottom flask equipped with a stirrer, a temperature gage, a nitrogen introduction pipe and a dehydration pipe was charged with 132.2 g (1.00 mol) of N,N-dihydroxyethyl-N-methylamine and 437.4 g (1.54 mol) of oleic acid. The mixture was raised to 190° C. The mixture was reacted for 9 hours under normal pressure and then cooled to obtain a mixture of N-oleoyloxyethyl-N-hydroxyethyl-N-methylamine and N,N-dioleoyloxyethyl-N-methylamine. 300.0 g of the mixture and 58.4 g of ethanol were placed in an autoclave equipped with a stirrer, a temperature gage and an introduction pipe and 39.9 g (0.791 mol) of methyl chloride was introduced under pressure into the autoclave. After that, the mixture was raised to 100° C. and reacted for 6 hours. After the reaction mixture was cooled to 60° C., the residual pressure was blown down to obtain an intended mixture of N-oleoyloxyethyl-N-hydroxyethyl-N,N-dimethylammonium chloride and N,N-dioleoyloxyethyl-N,N-dimethylammonium chloride (weight ratio: 65/35) (ab-2).

Example 1

Using the following components, softener compositions shown in Table 1 to Table 4 were prepared. At this time, the component (d), the component (f), the component (g) and the component (h) were dissolved in water and the mixture was raised to 60° C. The component (a), the component (b), the component (c) and as required the component (e) and the component (i) were added to the mixture at 60° C. with stirring using a stirring blade. The resulting mixture was adjusted to a given pH by using an aqueous 35% hydrochloric acid solution and an aqueous 48% sodium hydroxide solution. Then the remainder component (j) was added to the mixture, which was then cooled to ambient temperature. It is to be noted that almost all of the components (a-1), (a-2), (b-1), (b-2), (b-3) and (b-7) are present in a state of a hydrochloride in the composition.

The flexibility and feeling of the resulting softener compositions were evaluated by the following method and further, the compositions shown in Table 3 and Table 4 were also examined on their appearances. The results are shown in Table 1 to Table 4.

<Compounding Component>

(a-1): N-alkanoyloxyethyl-N,N-dimethylamine obtained in Synthetic Example 1

(a-2): N-stearoylaminopropyl-N,N-dimethylamine obtained in Synthetic Example 2

(a-3): N-oleoylaminopropyl-N,N-dimethylamine obtained in Synthetic Example 3

(a-4): N-alkanoyloxyethyl-N,N,N-trimethylammonium chloride obtained in Synthetic Example 4

(a-5): N-stearoylaminopropyl-N,N,N-trimethylammonium chloride obtained in Synthetic Example 5

(a-6): N-oleoylaminopropyl-N,N,N-trimethylammonium chloride obtained in Synthetic Example 6

(b-1): N,N-distearoyloxyethyl-N-methylamine (b-2): N,N-dioleoyloxyethyl-N-methylamine (b-3): N-alkanoylaminopropyl-N-alkanoyloxyethyl-N-methylamine (alkanoyl group: stearoyl group/palmitoyl group (mol ratio: 50/50))

(b-4): N,N-distearoyloxyethyl-N,N-dimethylammonium chloride (b-5): N,N-dioleoyloxyethyl-N,N-dimethylammonium chloride (b-6): N-alkanoylaminopropyl-N-alkanoyloxyethyl-N,N-dimethylammonium chloride (alkanoyl group: stearoyl group/palmitoyl group (mol ratio: 50/50))

(b-7): Dialkyldimethylammonium chloride (alkyl group: lauryl group/myristyl group (mol ratio: 50/50))

(b-8): N-alkanoylaminopropyl-N-alkanoyloxyethyl-N,N-dimethylammonium chloride (alkanoyl group: lauroyl group/myristoyl group (mol ratio: 50/50))

(b-9): Dialkyldimethylammonium chloride [an oxo type alcohol (the content of a methyl -branched alkyl type alcohol in the alcohol is 25 mol %) obtained by hydroformylating 1-alkene, in which the mol ratio of carbon numbers $C_{12}/C_{13}/C_{14}/C_{15}$ is 20/30/30/20, by using carbon monoxide is reacted with monomethylamine by using a nickel catalyst to obtain a dialkylmethylamine, which is alkylated using methyl chloride to obtain the target compound]

(c-1): Sodium stearyl sulfate (c-2): Sodium polyoxyethylene hydrogenated beef tallow composition alkyl sulfate (EO average addition mol number: 2.3, hydrogenated beef tallow composition: palmityl group/stearyl group (mass ratio: 40/60))

(c-3): Sodium Geurbet type alkylsulfate (sodium 2-octyldodecylsulfate) (obtained by sulfating 2-octyl-1-dodecanol by using sulfur trioxide and by further neutralizing the resulting product by using sodium hydroxide)

(c-4): Sodium Geurbet type alkyl ($C_{24}$) sulfate (sodium 2-decyltetradecylsulfate)

(d-1): 2-Phenoxyethanol (Clog P=1.16)

(d-2): Diethylene glycol monophenyl ether (Clog P=1.25)

(d-3): Dipropylene glycol monobutyl ether (Clog P=1.52)

(e-1): Stearic acid (e-2): Oleic acid (e-3): Lauric acid/myristic acid=50/50 (weight ratio)

(f-1): Obtained by adding EO (average 20 mols) to a saturated alcohol having 12 carbon atoms)

(f-2): Obtained by adding EO (average 30 mols) to stearylamine (g-1): Sodium chloride (g-2): Magnesium chloride (h-1): Ethanol (i-1): Exel 150 [stearic acid mono-, di- and tri-glyceride mixture (mono: di: tri=60: 35: 5), manufactured by Kao Corporation]

(j-1): Silicon (manufactured by Dow Corning Toray Silicone Co., Ltd., BY-16-891)

(j-2): Pigment (Acid Blue 9)

(j-3): Perfume [a mixture of hexylcinnamicaldehyde (18), nerolinyarayara (4), tricyclodecenyl acetate (4), benzyl acetate (10), musk ketone (5), anisyl acetone (2), Sandal Mysore Core (2), aldehyde C14 peach (1), linalool (18), dihydroxymyrcenol (8), borneol (4), cedrol (4), mugol (5), benzyl alcohol (5) and dipropylene glycol (10): the numerals in the parenthesis are mass % in the perfume]

(j-4): 2,6-ditert-butyl-4-methylphenol

<Method of Evaluating Flexibility and Feeling>

Five bath towels (100% cotton) were washed using a commercially available weak-alkaline detergent (Attack, manufactured by Kao Corporation) in a washer (Two-bath type washer VH-360S1, manufactured by Toshiba Corporation, detergent concentration: 0.0667 mass %, city water used: 30 L, water temperature: 20° C., 10 minutes). Then, the detergent solution was drained away, the towels were dewatered for 3 minutes, 30 L of city water was poured into the washer and then, the towels were rinsed for 5 minutes. After water was drained, the towels were dewatered for 3 minutes. Thereafter, 30 L of city water was again poured into the washer, and rinsing and dewatering were carried out in the same manner. After this operation was repeated more once, 30 L of city water (an aqueous solution for evaluation) which was adjusted to pH 8.0 at 20° C. by using sodium carbonate and in which sodium alkylbenzenesulfonate with an alkyl group having 12 to 15 carbon atoms was dissolved in a concentration of 10 ppm was poured into the washer and 7 ml of each softener composition shown in Table 1 to Table 4 was added to the washing solution, followed by stirring for five minutes. After that, the bath towels were dewatered and air-dried.

The flexibility and feeling of the clothes treated above were judged according to the following standard by 10 panelists (10 men, 30 years-age) to calculate an average. The case where the average was 0 or more and less than 1 was judged to be ○, the case where the average was 1 or more and less than 1.5 was judged to be Δ and the case where the average was 1.5 or more was judged to be X.

(1) Standard of evaluation of flexibility

0: Finished very softly

1: Finished softly

2: Finished slightly softly

3: Not finished softly (2) Standard of evaluation of feeling

0: Not oily but fresh feeling

1: Less oily and fresh feeling

2: Slightly oily feeling

3: Oily feeling

<Method of the Evaluation of the Outward Appearance>

100 ml of each composition shown in Table 3 and Table 4 was poured into a wide-mouthed standard bottle PS No. 11 and the outward appearance of the composition was evaluated visually according to the following standard.

◎: Transparent

○: Seen turbid but almost transparent

Δ: Turbid

×: Precipitates were produced

TABLE 1

| | product of the present invention | | | | | | | |
|---|---|---|---|---|---|---|---|---|
| | 1 | 2 | 3 | 4 | 5 | 6 | 7 | 8 |
| Softener composition (mass %) | | | | | | | | |
| (a-1) | 16 | | | | | | 16 | |
| (a-2) | | 16 | | | | | | |
| (a-3) | | | 16 | | | | | |
| (a-4) | | | | 16 | | | | |
| (a-5) | | | | | 16 | | | 16 |
| (a-6) | | | | | | 16 | | |
| (b-1) | 3 | | | | | | | |
| (b-2) | | 3 | | | | | | |
| (b-3) | | | 3 | | | | 3 | 3 |
| (b-4) | | | | 3 | | | | |
| (b-5) | | | | | 3 | | | |
| (b-6) | | | | | | 3 | | |
| (c-1) | 4 | | | 4 | | | 4 | 4 |
| (c-2) | | 4 | | | 4 | | | |
| (c-3) | | | 4 | | | 4 | | |
| (e-1) | 0.3 | 0.2 | 0.1 | 0.3 | 0.2 | 0.1 | 0.3 | 0.3 |
| (e-2) | | 0.1 | 0.2 | | 0.1 | 0.2 | | |
| (f-1) | 3 | | 3 | | 3 | | 3 | |
| (f-2) | | 3 | | 3 | | 3 | | 3 |
| (g-1) | 0.02 | 0.02 | 0.02 | 0.02 | 0.02 | 0.02 | 0.02 | 0.02 |
| (h-1) | 1 | 1 | 1 | 1 | 1 | 1 | 1 | 1 |
| (i-1) | 0.1 | 0.1 | 0.1 | 0.1 | 0.1 | 0.1 | 0.1 | 0.1 |
| (j-1) | 0.5 | 0.5 | 0.5 | 0.5 | 0.5 | 0.5 | 0.5 | 0.5 |
| (j-2) | 0.0003 | 0.0003 | 0.0003 | 0.0003 | 0.0003 | 0.0003 | 0.0003 | 0.0003 |
| (j-3) | 0.5 | 0.5 | 0.5 | 0.5 | 0.5 | 0.5 | 0.5 | 0.5 |
| Ion exchange water and PH regulator | Balance | | | | | | | |
| Total | 100 mass % | | | | | | | |
| pH | 3.0 | 3.0 | 3.0 | 3.5 | 3.5 | 3.5 | 3.0 | 3.0 |
| [(a) + (b)]/(c) (molar ratio) | 83/17 | 85/15 | 85/15 | 81/19 | 84/16 | 83/17 | 83/17 | 80/20 |
| Result of evaluation | | | | | | | | |
| Softening effect | ○ | ○ | ○ | ○ | ○ | ○ | ○ | ○ |
| Feeling effect | ○ | ○ | ○ | ○ | ○ | ○ | ○ | ○ |

TABLE 2

| | Product of the present invention | | | Comparative product | | | |
|---|---|---|---|---|---|---|---|
| | 9 | 10 | 11 | 1 | 2 | 3 | 4 |
| Softener composition (mass %) | | | | | | | |
| (a-1) | | | | | | | |
| (a-2) | | | | | | | |
| (a-3) | | | | | | | |
| (a-4) | | | | | | | |
| (a-5) | 16 | 16 | 16 | 16 | | 4 | |
| (a-6) | | | | | | | |
| (b-1) | | | | | | | |
| (b-2) | | | | | | | |
| (b-3) | | | | | | | |
| (b-4) | 3 | | | | 16 | | 16 |
| (b-5) | | 3 | | | | | |
| (b-6) | | | 3 | | | 3 | |
| (c-1) | | | | | 4 | | |
| (c-2) | 4 | | | | | | |
| (c-3) | | 4 | 4 | 4 | | 16 | |
| (e-1) | 0.3 | 0.2 | 0.3 | 0.2 | 0.2 | | 0.2 |
| (e-2) | | 0.1 | | | | | |
| (f-1) | 3 | | 3 | | 3 | | 3 |
| (f-2) | | 3 | | 3 | | 3 | |
| (g-1) | 0.02 | 0.02 | 0.02 | 0.02 | 0.02 | 0.02 | 0.02 |

TABLE 2-continued

| | Product of the present invention | | | Comparative product | | | |
|---|---|---|---|---|---|---|---|
| | 9 | 10 | 11 | 1 | 2 | 3 | 4 |
| (h-1) | 1 | 1 | 1 | 1 | 1 | 1 | 1 |
| (i-1) | 0.1 | 0.1 | 0.1 | 0.1 | 0.1 | 0.1 | 0.1 |
| (j-1) | 0.5 | 0.5 | 0.5 | 0.5 | 0.5 | 0.5 | 0.5 |
| (j-2) | 0.0003 | 0.0003 | 0.0003 | 0.0003 | 0.0003 | 0.0003 | 0.0003 |
| (j-3) | 0.5 | 0.5 | 0.5 | 0.5 | 0.5 | 0.5 | 0.5 |
| Ion exchange water and pH regulator | | | | Balance | | | |
| Total | | | | 100 mass % | | | |
| pH | 3.5 | 3.5 | 3.5 | 3.5 | 3.5 | 3.5 | 3.5 |
| [(a) + (b)]/(c) (molar ratio) | 84/16 | 83/17 | 83/17 | 82/18 | 68/32 | 22/78 | — |
| Result of evaluation | | | | | | | |
| Softening effect | ○ | ○ | ○ | Δ | X | X | ○ |
| Feeling effect | ○ | ○ | ○ | ○ | ○ | ○ | X |

TABLE 3

| | Product of the present invention | | | | | | |
|---|---|---|---|---|---|---|---|
| | 12 | 13 | 14 | 15 | 16 | 17 | 18 |
| Softener composition (mass %) | | | | | | | |
| (a-1) | 10 | | | | | | |
| (a-2) | | 10 | | | | | |
| (a-3) | | | 10 | | | | |
| (a-4) | | | | 10 | | | |
| (a-5) | | | | | 10 | 10 | 10 |
| (a-6) | | | | | | | |
| (b-5) | 10 | | | | | 10 | |
| (b-6) | | | | | | | 10 |
| (b-7) | | 10 | | | | | |
| (b-8) | | | 10 | | | | |
| (b-9) | | | | 10 | 10 | | |
| (c-1) | | | 5 | 5 | | | |
| (c-2) | 5 | | | | | | |
| (c-4) | | 5 | | | 5 | 5 | 5 |
| (d-1) | | 15 | | | 10 | 10 | |
| (d-2) | 15 | | | 15 | | | |
| (d-3) | | | 15 | | | | 15 |
| (e-1) | 0.1 | 0.1 | | 0.1 | 0.1 | 0.1 | 0.2 |
| (e-2) | 0.1 | | 0.1 | | | 0.1 | |
| (e-3) | | 0.1 | 0.1 | | | | |
| (f-1) | 3 | | 3 | | 3 | | 3 |
| (f-2) | | 3 | | 3 | | 3 | |
| (g-1) | 1 | 1 | 1 | 1 | 1 | 1 | 1 |
| (h-1) | 2.5 | 2.5 | 2.5 | 2.5 | 2.5 | 2.5 | 2.5 |
| (i-1) | 0.2 | 0.2 | 0.2 | 0.2 | 0.2 | 0.2 | 0.2 |
| (j-1) | 0.1 | 0.1 | 0.1 | 0.1 | 0.1 | 0.1 | 0.1 |
| (j-2) | 0.0003 | 0.0003 | 0.0003 | 0.0003 | 0.0003 | 0.0003 | 0.0003 |
| (j-3) | 0.3 | 0.3 | 0.3 | 0.3 | 0.3 | 0.3 | 0.3 |
| (j-4) | 500 ppm | 500 ppm | 500 ppm | 500 ppm | 500 ppm | 500 ppm | 500 ppm |
| Ion exchange water and pH regulator | | | | Balance | | | |
| Total | | | | 100 mass % | | | |
| pH | 3.0 | 3.0 | 3.0 | 3.5 | 3.5 | 3.5 | 3.5 |
| [(a) + (b)]/(c) (molar ratio) | 80/20 | 81/19 | 77/23 | 78/22 | 81/19 | 78/22 | 78/22 |
| Result of evaluation | | | | | | | |
| Softening effect | ○ | ○ | ○ | ○ | ○ | ○ | ○ |
| Feeling effect | ○ | ○ | ○ | ○ | ○ | ○ | ○ |
| Evaluation of outward appearance | ○ | ◎ | ○ | ○ | ◎ | ◎ | ○ |

TABLE 4

| | Product of the present invention | | | | | Comparative product | | | |
|---|---|---|---|---|---|---|---|---|---|
| | 19 | 20 | 21 | 22 | 23 | 5 | 6 | 7 | 8 |
| Softener composition (mass %) | | | | | | | | | |
| (a-1) | | | | | | | | | 18 |
| (a-2) | | 10 | 9 | 9 | | | | | |
| (a-3) | | | | | | | | | |
| (a-4) | | | | | | | | | |
| (a-5) | | | | | 9 | | | 5 | |
| (a-6) | 10 | | | | | | | | |
| (b-5) | 10 | | | | | 24 | 20 | | |
| (b-6) | | | | | | | | | |
| (b-7) | | 10 | 10 | | 10 | | | | |
| (b-8) | | | | 10 | | | | | |
| (b-9) | | | | | | | | 5 | |
| (c-1) | | | | | | | 5 | | |
| (c-2) | | | | | | | | | 7 |
| (c-4) | 5 | 5 | 6 | 6 | 6 | 1 | | 15 | |
| (d-1) | | 2.5 | 15 | 20 | | | | 15 | |
| (d-2) | | | | | 25 | | | | |
| (d-3) | 15 | | | | | 15 | | | 15 |
| (e-1) | | | 0.2 | | | | | 0.05 | 0.2 |
| (e-2) | 0.2 | 0.1 | | | | 0.2 | 0.2 | | |
| (e-3) | | 0.1 | | | | | | | |
| (f-1) | | 3 | 1 | | 1 | | 3 | | 3 |
| (f-2) | 3 | | | 1 | | 3 | | 3 | |
| (g-1) | 1 | 1 | | 1 | | 1 | 1 | 1 | 1 |
| (g-2) | | | 0.4 | | 0.4 | | | | |
| (h-1) | 2.5 | 2.5 | 2 | 2 | 2 | 2.5 | 2.5 | 2.5 | 2.5 |
| (i-1) | 0.2 | 0.2 | | | | 0.2 | 0.2 | 0.2 | 0.2 |
| (j-1) | 0.1 | 0.1 | | | | 0.1 | 0.1 | 0.1 | 0.1 |
| (j-2) | 0.0003 | 0.0003 | 0.0030 | 0.0030 | 0.0030 | 0.0003 | 0.0003 | 0.0003 | 0.0003 |
| (j-3) | 0.3 | 0.3 | 0.3 | 0.3 | 0.3 | 0.3 | 0.3 | 0.3 | 0.3 |
| (j-4) | 500 ppm | 500 ppm | 500 ppm | 500 ppm | 500 ppm | 500 ppm | 500 ppm | 500 ppm | 500 ppm |
| Ion exchange water and pH regulator | | | | | Balance | | | | |
| Total | | | | | 100 mass % | | | | |
| pH | 3.5 | 3.5 | 3.5 | 3.5 | 3.5 | 3.5 | 3.5 | 3.5 | 3.0 |
| [(a) + (b)]/(c) (molar ratio) | 78/22 | 81/19 | 77/23 | 75/25 | 76/24 | 94/6 | 68/32 | 35/65 | 78/22 |
| Result of evaluation | | | | | | | | | |
| Softening effect | ○ | ○ | ○ | ○ | ○ | ○ | X | X | Δ |
| Feeling effect | ○ | ○ | ○ | ○ | ○ | X | X | ○ | ○ |
| Evaluation of outward appearance | ◎ | ◎ | ◎ | ◎ | ○ | X | X | X | X |

Example 2

Using the following components, softener compositions shown in Table 5 were prepared. At this time, the component (d), the component (f) and the component (h) were dissolved in water and the mixture was raised up to 60° C. The component (ab) (a mixture of the component (a) and the component (b)), the component (c) and the component (e) were added to the mixture at 60° C. with stirring using a stirring blade. The resulting reaction mixture was adjusted to a prescribed pH by using an aqueous 35% hydrochloric acid and an aqueous 48% sodium hydroxide solution. Thereafter, the remainder component (j) was added to the mixture, which was cooled to ambient temperature.

The evaluation of the resulting softener composition was made as to flexibility, feeling and outward appearance in the same manner as in Example 1. The results are shown in Table 5.

<Compounding Component>

(ab-1): Mixture of N-oleoylaminopropyl-N-hydroxyethyl-N,N-dimethylammonium chloride and N-oleoylaminopropyl-N-oleoyloxyethyl-N,N-dimethylammonium chloride (weight ratio: 65/35) obtained in Synthetic Example 7.

(ab-2): Mixture of N-oleoyloxyethyl-N-hydroxyethyl-N,N-dimethylammonium chloride and N,N-dioleoyloxyethyl-N,N-dimethylammonium chloride (weight ratio: 65/35) obtained in Synthetic Example 8.

(c-4), (d-1), (e-2), (f-1), (h-1), (j -2), (j -3) and (j-4): the same as in Example 1.

TABLE 5

| | Product of the present invention | |
|---|---|---|
| | 21 | 22 |
| Softener composition (mass %) | | |
| (ab-1) | 21 | |
| (ab-2) | | 21 |

TABLE 5-continued

| | Product of the present invention | |
|---|---|---|
| | 21 | 22 |
| (c-4) | 4 | 4 |
| (d-1) | 10 | 10 |
| (e-2) | 0.4 | 0.4 |
| (f-1) | 1 | 1 |
| (h-1) | 2 | 2 |
| (j-2) | 0.0003 | 0.0003 |
| (j-3) | 0.5 | 0.5 |
| (j-4) | 500 ppm | 500 ppm |
| Ion exchange water and pH regulator | Balance | |
| Total | 100 mass % | |
| pH | 3.0 | 3.0 |
| [(a) + (b)]/(c) (mol ratio) | 79/21 | 80/20 |
| Result of evaluation | | |
| Softening effect | ○ | ○ |
| Feeling effect | ○ | ○ |
| Evaluation of outward appearance | ◎ | ◎ |

What is claimed is:

1. A softener composition comprising the following component (a), component (b) and component (c), wherein the mole ratio between the component (a), the component (b) and the component (c) satisfies the following relationship: [(a)+(b)]/(c)=9/1 to 4/6:

(a) a tertiary amine represented by formula (1) or a salt thereof:

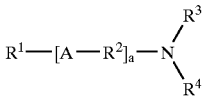

(1)

wherein $R^1$ represents an alkyl group or an alkenyl group having 13 to 36 carbon atoms, $R^2$ represents an alkylene group having 1 to 6 carbon atoms, $R^3$ and $R^4$ respectively represent an alkyl group or a hydroxyalkyl group having 1 to 3 carbon atoms, A represents a group selected from —COO—, —OCO—, —CONH— or —NHCO—, a denotes a number of 0 or 1;

(b) a quaternary ammonium salt represented by the formula (4):

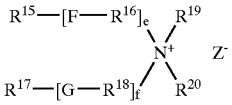

(4)

wherein $R^{15}$ and $R^{17}$ respectively represent an alkyl group or an alkenyl group having 8 to 36 carbon atoms, $R^{16}$ and $R^{18}$ respectively represent an alkylene group having 1 to 6 carbon atoms, $R^{19}$ represents an alkyl or hydroxyalkyl group having 1 to 3 carbon atoms or a group represented by the formula $R^{15}$—[F—$R^{16}$]$_e$—, $R^{20}$ represents an alkyl group or a hydroxyalkyl group having 1 to 3 carbon atoms, F and G respectively represent a group selected from —COO—, —OCO—, —CONH— and —NHCO—, e and f respectively denote a number of 0 or 1 and $Z^-$ represents an anionic group;

(c) an anionic surfactant having a hydrocarbon group having 8 to 36 carbon atoms and a —$SO_3M$ group and/or a $OSO_3M$ group (M: counter ion) in its molecule.

2. The softener composition according to claim 1, wherein the mass ratio (a)/(b) of the component (a) to the component (b) is 1/10 to 100/1.

3. The softener composition according to claim 1 or 2, wherein the number of the carbons of the hydrocarbon group in the component (c) is 14 to 36.

* * * * *